United States Patent [19]

Suomi

[11] 4,258,765

[45] Mar. 31, 1981

[54] LOG SPLITTER FOR A TRUCK HAVING A THREE-POINT SNOWPLOW HITCH AND HYDRAULIC PRESSURE SYSTEM

[76] Inventor: Roy A. Suomi, 10594 Ridgewater Dr., Painesville, Ohio 44077

[21] Appl. No.: 40,949

[22] Filed: May 21, 1979

[51] Int. Cl.[3] ..... B27L 7/00

[52] U.S. Cl. ..... 144/193 A; 172/449; 180/53 FE; 280/460 A

[58] Field of Search ..... 280/460 A, 481; 180/53 R, 53 C, 53 FE; 172/439, 449, 451; 144/3 K, 193 R, 193 A

[56] References Cited

U.S. PATENT DOCUMENTS

| | | | |
|---|---|---|---|
| 2,490,698 | 12/1949 | McClenny | 180/53 C |
| 2,581,535 | 1/1952 | Jackson | 180/53 C |
| 2,712,358 | 7/1955 | Kuhary et al. | 180/53 C |
| 2,749,823 | 6/1956 | Mitchell | 180/53 C |
| 3,001,590 | 9/1961 | Tsuchiya | 172/446 |
| 3,319,675 | 5/1967 | Bles, Sr. | 144/193 A |
| 3,356,115 | 12/1967 | Cole | 144/193 R |
| 3,760,854 | 9/1973 | Worthington | 144/193 A |
| 3,779,295 | 12/1973 | Balsbaugh | 144/193 A |
| 3,938,567 | 2/1976 | Direksen et al. | 144/193 A |

*Primary Examiner*—W. Donald Bray

*Attorney, Agent, or Firm*—Maky, Renner, Otto & Boisselle

[57] ABSTRACT

A hydraulic log splitter for connection to the three-point snowplow hitch and the hydraulic pressure system of a truck so that the log supporting beam in log splitting position of the splitter is near the ground in a region close to and parallel to the front end of the truck, the beam having a transversely rearwardly and horizontally extending frame which at its rear end is pivotally connected to the lower hitch points for swinging of the beam and frame upwardly and toward the front end of the truck to a traveling position by a chain connected to the frame and to the upper hydraulically actuated hitch point. The log splitter cylinder on the beam which actuates a log pusher plate toward a wedge on the beam has flexible hoses connected to the hydraulic pressure system fluid pressure supply and return conduits which are accessible from the front end of the truck.

6 Claims, 5 Drawing Figures

LOG SPLITTER FOR A TRUCK HAVING A THREE-POINT SNOWPLOW HITCH AND HYDRAULIC PRESSURE SYSTEM

BACKGROUND OF THE INVENTION

Hydraulic log splitters in prevalent use are quite heavy and expensive in that they are an integral part of a trailer equipped with its own gasoline engine and its own hydraulic pressure system including a pump driven by the engine, a fluid reservoir, and a four-way control valve for actuating the hydraulic cylinder of the log splitter. For highway travel the log splitter trailer which is of 7 to 8 foot length from the trailer hitch must be equipped with stop lights and tail lights and when the towing vehicle is a passenger car, a station wagon, or like motor vehicle, off-road travel of the towing vehicle and the log splitter trailer to the location of the logs to be split may be impossible or difficult in soft or rough terrain or if backing or turning of the trailer in close quarters is required.

In another known form of hydraulic log splitter equipped with its own four-way control valve for the splitter cylinder, the cylinder end of the splitter beam has a vertically extending frame detachably connected to a hydraulically powered tractor hitch to extend rearwardly from between the drive wheels with the splitter control valve being connected by flexible hoses to the pump of the hydraulic system of the tractor.

SUMMARY OF THE INVENTION

In contradistinction to known hydraulic log splitters, the log splitter herein is characterized in that when it is connected to a truck-mounted snowplow hitch, the log supporting beam is close to and parallel to the front end of the truck for pivotal movement about the pair of lower hitch points from a generally horizontally extending log splitting position to a raised traveling position (beam swung upwardly and closer to front end of truck) upon operation of the hydraulically actuated upper hitch point. The log splitter cylinder has a pair of flexible hoses detachably connected to the pair of power angle conduits which are accessible at the front end of the truck and which are operatively associated with the truck hydraulic system including an engine driven pump, a reservoir, and a power angle four-way control valve located in the engine compartment of the truck.

In one form of the present invention the aforesaid control valve has, in addition to the control member in the cab of the truck, an external control member which extends through the grill of the truck for controlling the splitting and retracting strokes of the log splitting cylinder. There is also provided a manually adjustable engine throttle control member extending through the grill of the truck for varying engine speed to control the speed of actuation of the log splitter.

In another form of the invention herein the control valve will be shifted to one position by the control member in the cab and the log splitter beam or cylinder will have secured thereto a simple two position reversing valve operative to supply pressure in one power angle conduit to either end of the log splitter cylinder while fluid is returned via the other power angle conduit while the control valve in the engine compartment remains in the aforesaid shifted position.

DETAILED DESCRIPTION OF THE PREFERRED EMBODIMENTS

Figure 1:
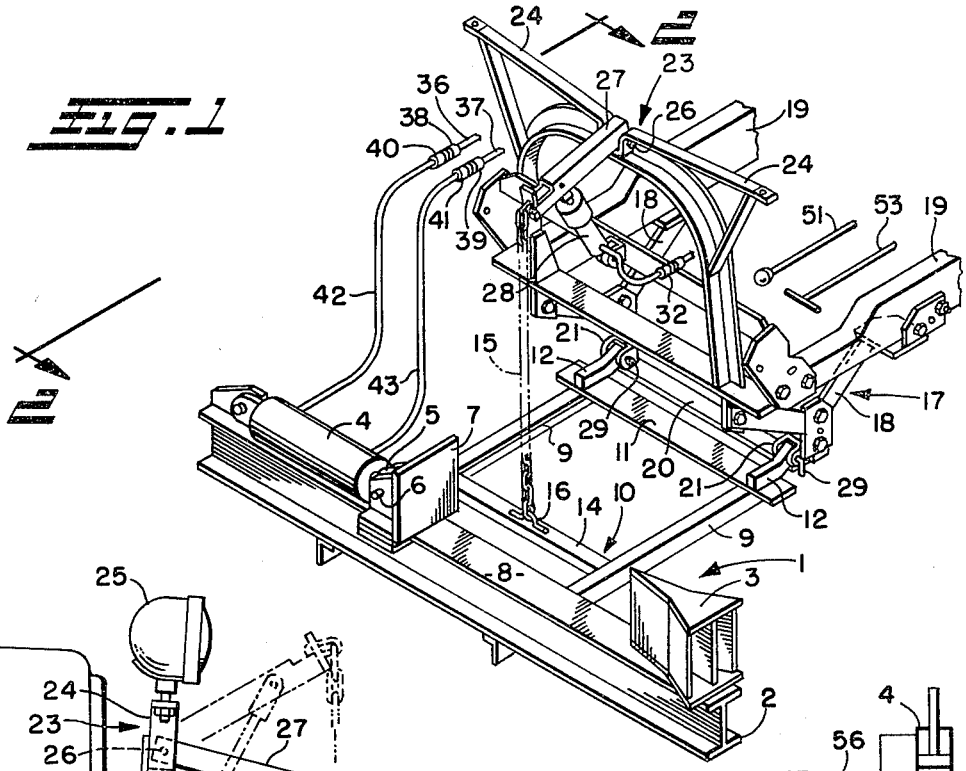
FIG. 1 is a perspective view of a hydraulic log splitter as attached to a truck mounted three-point hitch with the hydraulic cylinder of the log splitter operatively connected with the hydraulic pressure system of the truck.
Figure 2:
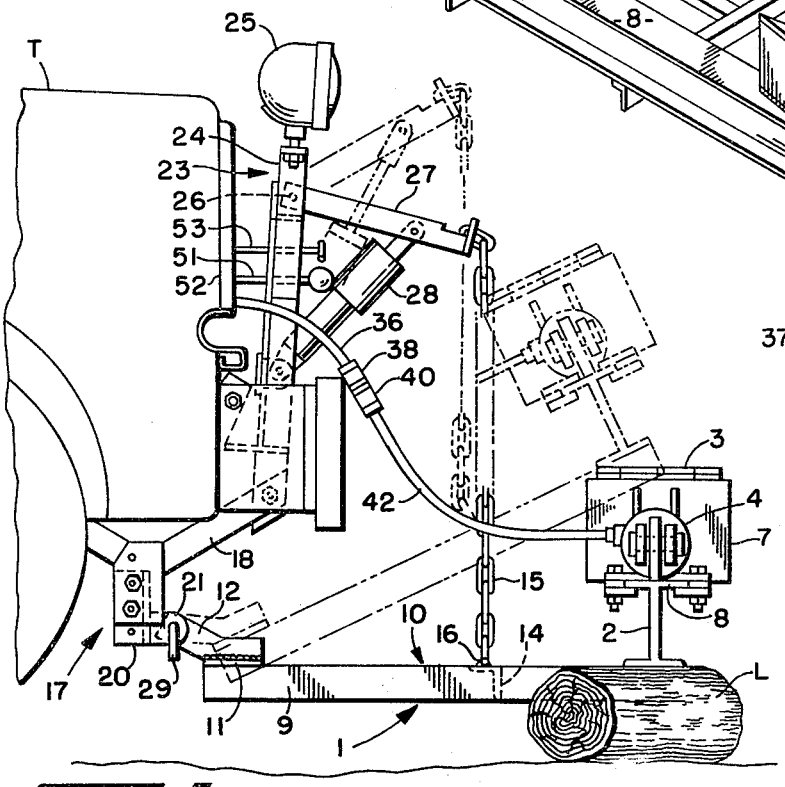
FIG. 2 is a side elevation view as viewed along the line 2—2 FIG. 1. showing in full lines the log splitter in its log splitting operation (full lines) and in its raised traveling position (phantom lines).

As shown in FIGS. 1 and 2 the hydraulic log splitter 1 herein comprises a beam 2 having secured thereonto adjacent its opposite ends a wedge 3 and a longitudinally extending hydraulic cylinder 4, the piston rod 5 of which is connected by pin 6 to a log pusher plate 7 which is longitudinally slide guided on the top flange 8 of the beam 2 for movement toward and away from the wedge 3 responsive actuation of said cylinder 4 in opposite directions. When the hydraulic cylinder 4 and pusher plate 7 are in retracted position as shown in FIG. 1 a log to be split is placed on the top flange 8 of the beam 2 between the wedge 3 and the pusher plate 7 whereupon actuation of the hydraulic cylinder 4 and pusher plate 7 toward the wedge 3, the log will be forced into cutting and splitting engagement with the wedge 3.

Welded or otherwise secured under the beam 2 are parallel side members 9 of a frame assembly 10 which extends transversely of the beam 2 and which has welded across the ends of the side members 9 remote from the ends attached to the beam 2, a cross member 11 with laterally spaced apart hinge brackets 12 welded or otherwise attached thereto having aligned openings parallel to the beam 2. The frame 10 also has an intermediate cross member 14 to which the lower end of a chain 15 or like element is secured by the clip 16 welded to the cross member 14.

A truck T equipped with a hydraulically operated snowplow will typically have a three-point hitch 17 including undercarriage side members 18 bolted to the truck frame 19 near the front end, and vertically adjustably bolted to the side members 18 as shown is a cross member 20 providing a lower pair of hitch points in the form of a clevis 21 at each end of cross member 20. Bolted or otherwise secured to the side members 18 is a lift frame assembly 23 which additionally may be bolted to the front end of the truck frame 19 to provide mounting brackets 24 for lights 25 and to provide a pivot 26 for the lift arm 27. The lift arm 27 constitutes the upper hitch point which is movable upwardly and downwardly by a hydraulic cylinder 28 which is pivotally connected to the lift arm 27 and to the lift frame 23 and which is operatively connected to the hydraulic pressure system within the engine compartment of the truck T. The upper end of the chain 15 is detachably and adjustably connected to the lift arm 27 shown so that when the cylinder 28 is extended the arm 27 will be swung upwardly about the pivot 26 to swing the log splitter 1 upwardy and closer toward the front end of the truck T about the pivots provided by the pins 29 which pivotally connect the hinge brackets 12 to the respective clevises 21, the pins 29 being retained by suitable hairpin or like spring clips (not shown).

With reference to the hydraulic system, the engine compartment has therein an engine driven hydraulic pump 30 mounted as on the engine block for driving as by a belt driven by the engine crankshaft, a three-position three-way valve 31 which through the quick disconnect valved coupling 32 provides in its neutral position a bypass passage 34 for supply of fluid to the three position four-way 35 which controls the actuation of the log splitting cylinder 4 through conduits 36 and 37 and valved disconnect male and female coupling halves 38 and 39 which are accessible from the front of the truck T and detachably connected to the female and male coupling halves 40 and 41 of the flexible hoses 42 and 43 connected to the respective head and rod ends of cylinder 4. When the three-way valve 31 is shifted to the left, the bypass passage 34 is closed and fluid under pressure delivered by the pump 30 is conducted through coupling 32 into the head end of the lift cylinder 28 thus to swing the log splitter 1 to phantom line position as indicated in FIG. 2. When the three-way valve is shifted to the right, the bypass passage 34 again is closed and the head end of the cylinder 28 is communicated with the reservior 45 to permit gravity lowering of the log splitter 1 from the raised phantom line position to solid line log splitting position as shown in FIG. 2 and in that position, especially on uneven ground, logs L may be placed under the ends of the beam 2 to prevent twisting strains on the frame 10 and unequal forces and shock loads on the hinge pins 29 at the lower hitch points 21.

Usually the three-way and four-way valves 31 and 35 will be secured to the inner fender within the engine compartment as will the reservoir 45 which for example may be of one gallon capacity.

The three-position four-way valve 35 also has a bypass passage 46 which conducts the pump 30 output to reservoir 45 when both valves 31 and 35 are in neutral position. When the four-way valve 35 is shifted to the left, the fluid pressure delivered by the pump 30 is conducted to the head end of the splitter cylinder 4 via the conduits 36 and 42 and open coupling halves 38 and 40 to force a log supported lengthwise on the flange 8 of the beam 2 between the pusher plate 7 and the wedge 3 against the wedge 3 to effect splitting of the log, and the fluid displaced from the rod end of the cylinder 4 is conducted through conduits 43 and 37 and open coupling halves 41 and 39 to the reservoir 45. When the log splitting operation has been concluded shifting of the four-way valve 35 to the right will communicate the rod end of the cylinder 4 with fluid pressure delivered by the pump 30 via conduits 37 and 43 and coupling halves 39 and 41 and the fluid displaced from the head end will be returned to the reservoir 45 via conduits 42 and 36 and coupling halves 40 and 38. To limit pressure build up in the system, as at the end of the stroke of the cylinder 4 or 28 being actuated, a relief valve 47 is provided so as to open communication between the pump discharge line 48 and the reservoir 45 when a predetermined maximum pressure is exceeded.

Figure 4:
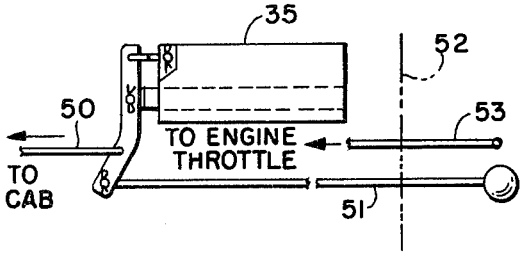
FIG. 4 shows the external operating mechanism for the three-position four-way control valve for controlling the operation of the log splitting hydraulic cylinder from the front end of the truck.
Figure 3:
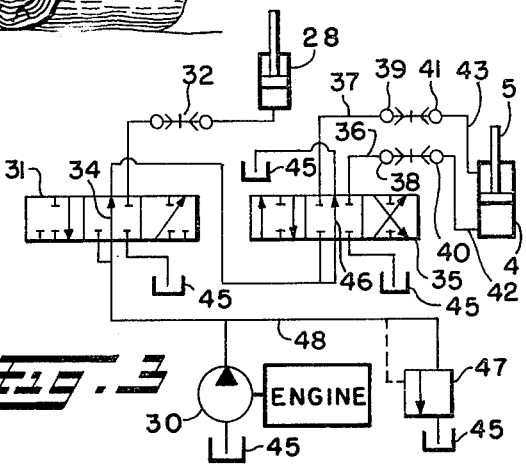
FIG. 3 is a schematic hydraulic circuit diagram for operating the log splitter from the hydraulic system in the engine compartment of the truck for performing log splitting operations and for hoisting the log splitter from lowered log splitting position to raised traveling position.

As shown in FIGS. 1, 2 and 4 the three position four-way valve 35 for snowplow operation will be provided with an actuating rod 50 within the truck cab for performing the angle adjusting function of a snowplow. For the log splitting operation herein a control rod 51 will be connected to the valve 35 as shown in FIG. 4 to extend through the grill 52 of the truck T for convenient operation adjacent to the log splitter 1. An engine throttle control rod 53 extends through the grill 52 and connects to the engine throttle so that when the log splitter 1 is in use, the engine speed may be varied to vary the speed of operation of the log splitter 1.

The connection of the upper end of the chain 15 to the end of the lift arm 27 is adjustable so that if desired when the piston bottoms in cylinder 28, the log splitter 1 will be in horizontally extending position as shown in FIG. 2 without requiring other support means such as the logs L shown. When the log splitter 1 is in its raised traveling position, the truck T may be easily driven in normal manner on the highway or off the road in rough terrain to the location of the logs to be split. To move to another location, it is a simple matter of actuate the three-way valve 31 to lift the log splitter 1 to traveling position and to lower the log splitter 1 to splitting position at the next location. When it is desired to disconnect the log splitter 1 from the truck T hydraulic system and the three-point hitch 17, the flexible hoses 42 and 43 may be quickly disconnected at the couplings 38–40 and 39–41, the chain 15 may readily be disconnected from the lift arm 27 and upon removal of the hairpin spring clips or the like (not shown) from the hinge pins 29, this latter may be removed from clevises 21 to completely disconnect the log splitter 1 from the three-point hitch 17. In like manner the snowplow (not shown) may be easily and quickly connected to pin the same to the pair of lower hitch points 21 and to attach the plow to the lift arm 27 and to connect the power angle hoses and coupling halves to the couplings halves 38 and 39.

Figure 5:
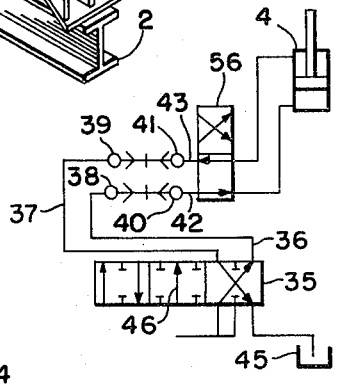
FIG. 5 is a schematic diagram similar to FIG. 3 except showing a modified construction in which a two-position reversing valve is mounted on the log splitter for convenient operation thereat without changing the position of the three-position four-way control valve within the engine compartment of the truck.

In the FIG. 5 embodiment of the invention, the four-way valve 35 will be shifted to one operating position by means of the control rod 50 in the truck cab thus to make one conduit 36 a pressure supply conduit and the other conduit 37 a return fluid conduit. In order to eliminate the need of operating the four-way control valve 35 as by the rod 51 extending through the grill 52 of the truck, the FIG. 5 embodiment provides a simple two position reversing valve 56 attached to the cylinder 4 or beam 2 so that upon operation of the two position reversing valve 56, the pressure supply conduit 36 will be communicated through the disconnect coupling 38–40 and conduit 42 with either end of the log splitting cylinder 4 while the other end is communicated with the fluid return conduit 37 via the conduits 43 and 37, disconnect coupling 41–39.

The embodiments of the invention in which an exclusive property or privilege is claimed are defined as follows:

1. A log splitter attachment for a motor vehicle having a three-point hitch at its front end including a pair of lower hitch points and an upper hitch point and having a hydraulic pressure system in its engine compartment including an engine driven pump, a reservoir, and a four-way control valve operatively interconnected together so that upon actuation of said valve either one of a pair of conduits therefrom accessible from the front of the vehicle is a fluid pressure line while the other one is a fluid return line; said attachment comprising an elongated horizontally extending beam having secured thereonto adjacent its respective ends a wedge and a double acting hydraulic cylinder including a pair of flexible conduits adapted to be connected to said pair of conduits; said beam having a pusher plate longitudinally slide guided thereon; said plate being operatively connected to the piston rod of said cylinder for movement of said plate from a retracted position whereat a log may be placed lengthwise on said beam between said plate and wedge to a log splitting position whereat said plate has forced the log into wedging and splitting engagement with said wedge responsive to actuation of said cylinder; said beam having secured to the bottom thereof one end of a transversely extending frame of which the other end remote from said beam has a pair of hinge brackets with aligned openings parallel to said beam and adapted to be pivotally pinned to said lower hitch points; said frame between said brackets and beam having an upwardly extended support element adapted to be connected at its upper end to said upper hitch point for supporting said attachment in a raised traveling position with said beam and frame swung upwardly and toward the front end of the vehicle about said lower hitch points from log splitting position; said upper hitch point having an adjustable connection to said support element to vary the length of said support element to determine the log splitting and traveling positions of said attachment.

2. The log splitter attachment of claim 1 wherein said control valve has an actuating member which extends through and is accessible from the front end of the vehicle for controlling the direction of actuation of said cylinder and pusher plate toward or away from said wedge.

3. The log splitter attachment of claim 2 wherein a engine throttle control member extends through and is accessible from the front end of the vehicle to vary vehicle engine speed thus to vary the rate of discharge of fluid pressure by said pump.

4. The log splitter attachment of claim 1 wherein said upper hitch point comprises a lift arm pivotally connected to said three-point hitch; and a single-acting hydraulic cylinder operatively connected between said hitch and said lift arm; said hydraulic pressure system having a three-way control valve and conduit means operative to selectively conduct fluid under pressure from said pump to said single-acting cylinder to swing said lift arm upwardly thus to lift said splitter to traveling position through said support element or to conduct fluid from said single-acting cylinder to said reservoir thus to lower said splitter by gravity to log splitting position; said support element comprising a length of chain adjustably connected to said lift arm.

5. The log splitter of claim 1 wherein said frame comprises parallel side members secured at one end to the bottom of said beam and having secured thereto at the other end a cross-member to which said hinge brackets are secured; and wherein said frame has another cross-member secured to said side members to which the lower end of said element is connected.

6. The log splitter of claim 1 wherein a reversing valve adacent to said cylinder is operative to selectively conduct fluid pressure in one flexible conduit to either end of said cylinder while the other end of said cylinder is communicated with the other flexible conduit.

* * * * *